US006645713B2

(12) United States Patent
Saito

(10) Patent No.: US 6,645,713 B2
(45) Date of Patent: Nov. 11, 2003

(54) METHOD OF MANUFACTURING SILVER HALIDE EMULSIONS AND APPARATUS THEREOF

(75) Inventor: Hirokazu Saito, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/825,942

(22) Filed: Apr. 5, 2001

(65) Prior Publication Data

US 2001/0028999 A1 Oct. 11, 2001

(30) Foreign Application Priority Data

Apr. 6, 2000 (JP) ..... 2000-104440

(51) Int. Cl.[7] ..... G03C 1/015
(52) U.S. Cl. ..... 430/569; 430/567
(58) Field of Search ..... 430/567, 569

(56) References Cited

U.S. PATENT DOCUMENTS 3,801,326 A * 4/1974 Claes ..... 430/567
4,359,526 A * 11/1982 Walworth ..... 430/568
4,879,208 A * 11/1989 Urabe ..... 430/569
5,004,679 A * 4/1991 Mifune et al. ..... 430/567
5,196,300 A * 3/1993 Urabe et al. ..... 430/568
5,576,170 A * 11/1996 Eikenberry et al. ..... 430/567
6,948,906 * 4/2000 Ernst et al. ..... 516/77
6,096,495 A * 8/2000 Kasai et al. ..... 430/569
6,218,098 B1 * 4/2001 Jezequel et al. ..... 430/569
6,312,882 B1 * 11/2001 Verbeeck ..... 430/569
6,338,940 B1 * 1/2002 Miyazawa et al. ..... 430/505
6,372,420 B1 * 4/2002 Miki et al. ..... 430/569
6,403,295 B1 * 6/2002 Urabe ..... 430/567
2001/0028999 A1 * 10/2001 Saito ..... 430/569
2002/0058215 A1 * 5/2002 Takahashi et al. ..... 430/567

* cited by examiner

*Primary Examiner*—Janet Baxter
*Assistant Examiner*—Amanda C. Walke
(74) *Attorney, Agent, or Firm*—Sughrue Mion, PLLC

(57) ABSTRACT

A high velocity jet of aqueous silver salt solution through the first tubing and a high velocity jet of aqueous halide salt solution through the second tubing are forced to merge in the merging zone to induce mixing action by means of kinetic energy of the fluid in the merging zone, aqueous hydrophilic dispersant solution in the third tubing is then supplied continuously between the two high velocity jets which have already merged to mix the three solutions in the merging zone instantaneously, and the mixed solution containing silver halide particles which have been formed by reaction caused by the mixing is immediately removed out of the merging zone.

8 Claims, 5 Drawing Sheets

PRIOR ART

METHOD OF MANUFACTURING SILVER HALIDE EMULSIONS AND APPARATUS THEREOF

BACKGROUND OF THE INVENTION

1. Field of the Invention

The present invention relates to method of manufacturing silver halide emulsions and apparatus thereof for producing photographic silver halide emulsions comprising silver halide particles.

2. Description of Related Art

There have been various types of method to form silver halide particles used as photographic photosensitive material.

Those particles are commonly formed by the reaction of silver ions and halide ions in a sufficiently great reactor equipped with a stirrer having a stirring blade or blades. In such a case, efficiency of stirring in the reactor is important, and therefore various types of stirring are proposed as described, for example, in Japanese Patent Application Laid-Open Nos. 7-219092, 8-171156 and 4-283741, Japanese Patent Publication Nos. 8-22739 and 55-10545, and U.S. Pat. No. 3,782,954.

In order to form silver halide particles (for example, particles with a high monodispersity, particles with a high ratio of plates in case of planar particles etc.) preferable as photographic silver halide emulsions, one of the functions required on these stirrers is to mix homogeneously and instantaneously in a microscopic scale. To achieve homogeneous mixing, a method is often adopted of diluting aqueous silver salt solution and aqueous halide salt solution to be added with a liquid already present in the reactor before both salts react with each other. However, the emulsion of silver halide particles thus obtained is commonly not preferable as photographic photosensitive material, unless they are well diluted. For example, in the case where the solutions are added in the phase of nuclear formation to prepare planar particles, a higher ratio of nonparallel cubic twin and a higher polydispersity of planar particles are observed in growing particles, if stirring is not sufficient and/or the solutions have not been diluted well. This phenomenon can be verified by decreasing revolving speed using the stirrer which is described in Japanese Patent Publication No. 55-10545.

Furthermore, in the case where poor dilution occurs in the growing phase, new nuclei form near the inlet for addition and remain as solid without complete dissolution, so that particles formed in the growing phase are incorporated into the emulsion of silver halide particles obtained. Such a phenomenon is observed markedly in the particular case of growth at a high supersaturation.

The above discussion suggests that stirring is important and active use of the bulk solution for dilution may be preferred. However, since the bulk solution usually contains particles already formed, the problem of recirculation then arises wherein particles once formed circulates again near the entering solutions. If recirculation occurs in the phase of nuclear formation, recirculating nuclei prevents formation of new nuclei. Accordingly, in the case where an emulsion of smaller particles is to be prepared, for example, increased addition of the solutions for nuclear formation will not bring about corresponding increase in nuclear formation, indicating that recirculation exerts an adverse effect on formation of smaller particles. In addition, since a difference in particle size arises between nuclei grown by recirculation and those not grown, nuclear polydispersity due to recirculation makes it difficult to prepare an emulsion of monodispersed particles, indicating again that recirculation exerts an adverse effect.

A method of applying microparticles prepared preliminarily to the nuclear formation process or the nuclear growth process is available in order to solve these problems. In this method, aqueous silver salt solution, aqueous halide salt solution, and in many cases, aqueous solution of a dipersing agent as well are introduced into a reaction vessel of small volume, while microparticles are removed through the outlet in parallel and continuously. The microparticles obtained can be used for nuclear formation and/or nuclear growth.

This method has the advantage of achieving more easily increased formation of nuclei due to much less recirculation. It is desirable to minimize the size of produced nuclei in order to maximize the number of nuclei. However, more powerful stirring is required to attain satisfactory mixing because the stirrer used in this method cannot take advantage of the above-mentioned dilution effect caused by the bulk solution. In case of unsatisfactory stirring, for example, for preparing an emulsion of planar particles, increased production of undesirable non-planar particles is one of the problems. In the mixer, as described in Japanese Patent Application Laid-Open No. 6-507255, the ratio of non-planar particles increases, compared to a mixer used in the presence of circulating bulk solution. In addition, in the mixer, as described in Japanese Patent Application Laid-Open No. 8-332364, high speed stirring has difficulty in keeping the perimeter of the rotational axis sealed.

Silver halide microparticles may be also introduced into another reaction vessel containing silver halide seed particles to grow the seed particles. Silver halide microparticles can be formed using the stirrer described in Japanese Patent Application Laid-Open No. 10-43570, or Japanese Patent Application Laid-Open No. 1-183417, and they can be used for growing seed particles.

The stirrer, for example, described in Japanese Patent Application Laid-Open No. 10-43570, as shown in FIG. 3, comprises a stirring container 5 where a given number of inlets 1, 2 and 3 are provided to introduce liquids to be mixed and an outlet 4 is also provided to remove the liquid produced after they are stirred, a pair of stirring blades 6, 6 which are arranged at facing positions spaced apart in the stirring container 5 and driven to rotate in directions opposite to each other so as to control the stirred state of the liquid in the stirring container, and driving means 8, 8 which arrange outer magnets 7, 7 out of the stirring container, the magnets 7, 7 being composed of magnetic couplings which are aligned close to the respective stirring blades 6, 6 out of the walls of the stirring container and without a through axis, and drives the outer magnets 7, 7 rotationally so as to revolve the stirring blades 6, 6.

Use of this method enables uniform mixed crystals or very thin planar particles to be prepared because a highly concentrated area of silver ions or halide ions is unlikely to exist, compared with the method of adding aqueous silver salt solution and aqueous halide salt solution. In this method, silver halide microparticles as source of seed particles are preferably dissolved rapidly, and for the purpose preferably have small diameters and no crystal defects such as twin.

In case of using silver halide microparticles for growing seed particles, aqueous silver salt solution and aqueous halide salt solution preferably have higher concentrations when they are added on formation of silver halide microparticles. However, as the concentrations of the solutions to be added increase, produced microparticles tends to have polydispersity due to no available dilution by the bulk solution, and when the microparticles are transferred into the vessel for growing seed crystals, larger particles or particles containing twin become undissolved to remain. These remaining microparticles interfere with spectral and chemical sensitizations of the emulsion of silver halide particles, and also cause unfavorable light scattering, indicating that such an emulsion of silver halide particles containing remaining microparticles of silver halide is not preferable as photographic photosensitive material.

Accordingly, obtaining an emulsion of silver halide microparticles with small mean size or an emulsion of silver Halide microparticles with monodispersity is important to obtain an emulsion of silver halide particles favorable as photographic photosensitive material.

As another method of forming silver halide particles which is different from the mixing means described above using stirring blades for revolution, a method of manufacturing an emulsion of silver halide microparticles by flowing in line solutions submitted for reaction and applying kinetic energy of the fluids to mixing reaction is disclosed in Japanese Patent Application Laid-Open Nos. 4-139440 and 4-139441, U.S. Pat. No. 5,484,697 and Japanese Patent Application Laid-Open No. 11-217217.

For example, the apparatus described in Japanese Patent Application Laid-Open No. 4-139440, as shown in FIG. 4, is configured so that silver salt solution is introduced through the front end 10A of the nozzle 10, while halide salt solution is introduced through the front end 11A of the nozzle 11, and the resultant silver halide is discharged through the outlet 12. As another example, the apparatus described in Japanese Patent Application Laid-Open No. 4-139441, as shown in FIGS. 5(*a*) and 5(*b*), is configured so that a flow of silver salt solution in the nozzle 13 is a counterflow against a flow of halide salt solution in the nozzle 14 at the merging zone 15, and silver halide particles produced there by means of mixing reaction is discharged via the channel 16. Reference characters 13A and 14A denote the front ends of both nozzles.

However, in any method disclosed in these publications, Japanese Patent Application Laid-Open Nos. 4-139440 and 4-139441, U.S. Pat. No. 5,484,697 and Japanese Patent Application Laid-Open No. 11-217217, the concentrations of the solutions undergoing the reaction must be only not more than 0.3 mol/l to achieve formation of microparticles of intended size and prevent agglomeration of the particles, resulting in too low a productivity to produce the particles commercially.

For example, in U.S. Pat. No. 5,484,697, the claims describe that the concentration of silver salt solutions in use ranges from 0.04 to 0.3 mol/l. In Japanese Patent Application Laid-Open Nos. 4-139440, 4-139441 and 11-217217, the concentrations of the solutions used for mixing reaction are not more than 0.5 mol/l in any case.

Furthermore, in the methods disclosed in these publications, at the front ends 10A to 14A where silver salt solution and halide salt solution meets for a moment, agglomerates have deposited in clods and it has been difficult to obtain microparticles with uniform performance steadily. The reason is supposed as follows: on the wall itself of the nozzle tube where the solution flows, the flow rate of the solution is zero, and so a portion of particles produced by the reaction does not flow but deposits gradually on the wall of the nozzle tube to form clods of agglomerates. When the reaction solution flows for a long time in a stationary state where the Reynolds number is not more than 2,100, especially as described in U.S. Pat. No. 5,484,697, this phenomenon of agglomeration becomes remarkable. In addition, as shown in Japanese Patent Application Laid-Open No. 11-217217, even when the Reynolds number is 3,000 or more, the solution flowing at the mean velocity of 5 to 6 m/sec causes agglomeration similar to that described above if the solution has a concentration of 0.1 mol/l or more.

In this way, conventional methods or apparatus of manufacturing silver halide emulsions cannot steadily produce microparticles of mean size not more than 0.3 $\mu$m and their commercial production is not feasible.

SUMMARY OF THE INVENTION

The present invention has been attained considering this state of the art and eliminated conventional defects. The object of the invention is to present a method of manufacturing silver halide emulsions and apparatus thereof, wherein microparticles for silver halide emulsions which are microscopic, monodisperse and of a low rate of twin formation can be produced with a high productivity, even when the concentration of aqueous silver salt solution in use is 0.3 mol/l or more.

In order to attain the object described above, the present invention is directed to a method of manufacturing a silver halide emulsion, wherein: a jet of aqueous silver salt solution and a jet of aqueous halide salt solution are forced to merge in a merging zone to induce mixing action by means of kinetic energy of fluid in the merging zone; aqueous hydrophilic dispersant solution is then supplied continuously between the two jets which have already merged to mix the three solutions instantaneously; and the mixed solution containing silver halide particles which have been formed by reaction caused by the mixing is immediately removed out of the merging zone.

Further, in order to attain the object described above, the present invention is directed to an apparatus for manufacturing a silver halide emulsion, the apparatus comprising: a mixing reaction pipe comprising: a first tubing through which aqueous silver salt solution flows; a second tubing through which aqueous halide salt solution flows; a third tubing through which aqueous hydrophilic dispersant solution flows; and an exhaust pipe, wherein in a merging zone where outlets of the first and second tubings are merged, an outlet of the third tubing is merged so as to be placed between the outlets of the first and second tubings, the exhaust pipe is provided to discharge out of said merging zone a mixed solution of said three solutions that have merged in said merging zone, and mixing reaction in said merging zone forms silver halide particles; a first jet forming device which forms a jet of the aqueous silver salt solution charged through said first tubing into said merging zone; a second jet forming device which forms a jet of the aqueous halide salt solution charged through said second tubing into said merging zone; and a metering device which meters the aqueous hydrophilic dispersant solution flowing in said third tubing into said merging zone.

According to the invention, aqueous silver salt solution and aqueous halide salt solution are discharged in the form of jet through each outlet of the respective tubings into the merging zone, and therefore silver halide particles produced by reaction do not deposit as agglomerating clods at the front ends where aqueous silver salt solution and aqueous halide salt solution meet. In this case, flow velocity of jets is preferably not less than 100 m/sec. In addition, when two jets of aqueous silver salt solution and aqueous halide salt solution merge, aqueous hydrophilic dispersant solution is continuously supplied between the two jets, resulting in preventing silver halide particles from agglomerating. Particles then produced in the merging zone are removed at once out of the merging zone. As a result, the phenomena of generation of agglomerating clods is difficult to occur even if the silver salt concentration of aqueous silver salt solution and/or the halide salt concentration of aqueous halide salt solution are elevated, and thereby microparticles for silver halide emulsions which are microscopic, monodisperse and of a low rate of twin formation can be produced in a high concentration range of aqueous silver salt solution and aqueous halide salt solution.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

Preferred embodiments of a manufacturing method of silver halide emulsions and the apparatus thereof according to the present invention will be described below using appended drawings.

Figure 1:
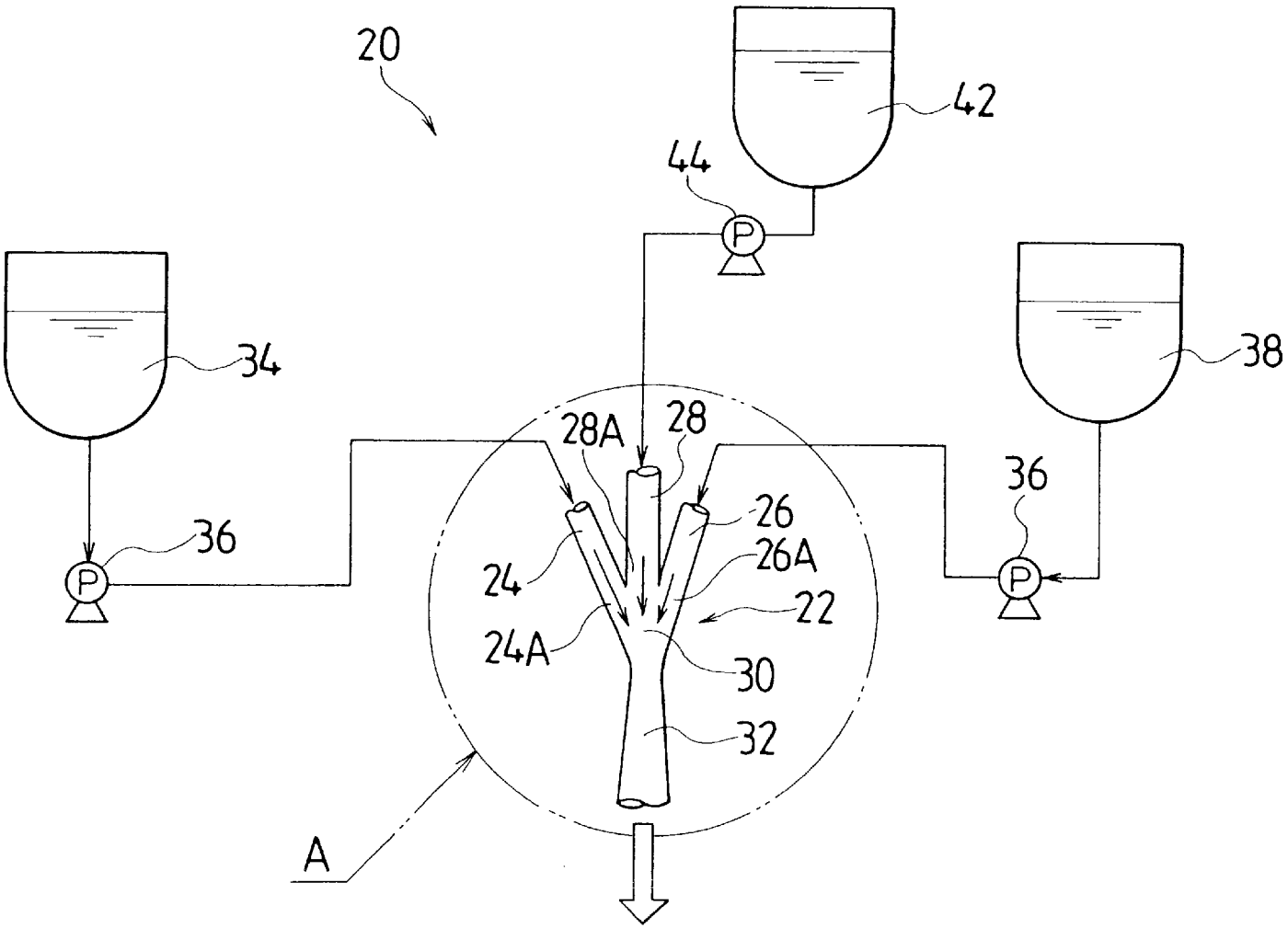
FIG. 1 shows a schematic view of the whole configuration illustrating the apparatus for manufacturing silver halide emulsions according to the present invention.
Figure 2:
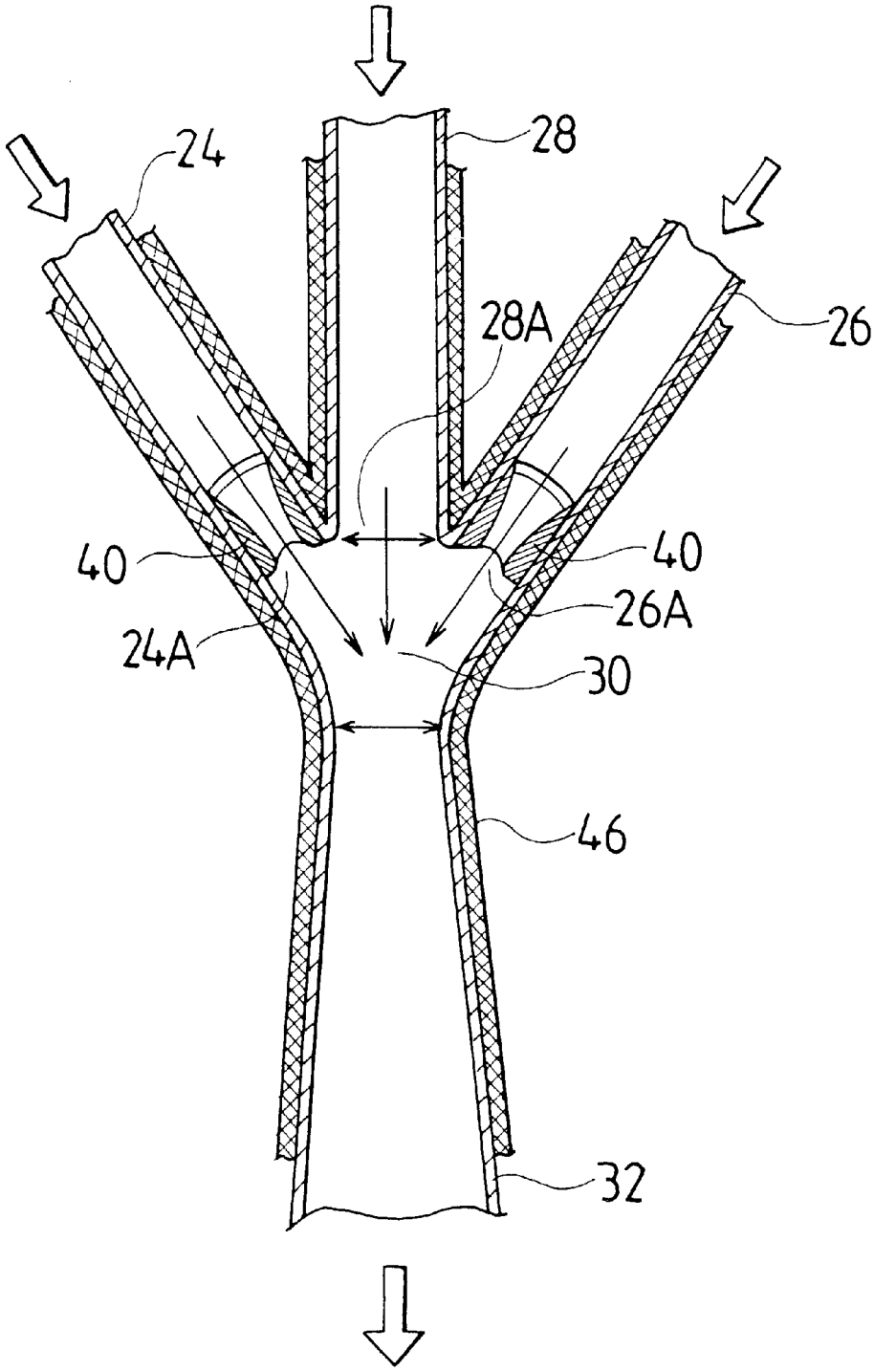
FIG. 2 shows a longitudinal section of the partial enlargement of the portion A in FIG. 1.

FIG. 1 shows the whole configuration illustrating the embodiment of the apparatus for manufacturing silver halide emulsions according to the present invention, and FIG. 2 shows the partial enlargement of the portion A in FIG. 1.

As depicted in these figures, the manufacturing apparatus 20 according to the present invention is mainly composed of a mixing reaction pipe 22, which is based on in-line static mixing caused by kinetic energy of the fluids rather than by stirring blades.

In the mixing reaction pipe 22, three tubings 24, 26 and 28 merge to form a merging zone 30, and an exhaust tubing 32 is connected to the merging zone 30. Three tubings 24, 26 and 28 aforementioned are composed of the first tubing 24 to take in aqueous silver salt solution, the second tubing 26 to take in aqueous halide salt solution and the third tubing 28 to take in aqueous hydrophilic dispersant solution as moisturizer, and they are configured so that the outlet 28A of the third tubing 28 may be arranged between the outlet 24A of the first tubing 24 and the outlet 26A of the second tubing 26 in the merging zone.

The first tubing 24 is connected to the first storage tank 34 for storing aqueous silver salt solution, and a non-pulsating high pressure pump 36 able to transfer the solution under the pressure of 10 to 400 MPa is provided for the first tubing 24. The second tubing 26 is connected to the second storage tank 38 for storing aqueous halide salt solution, and a non-pulsating high pressure pump 36 able to transfer the solution under the pressure of 10 to 400 MPa is also provided for the second tubing 26. The pulsating rate of this non-pulsating high pressure pump 36 is preferably not more than 4% and more preferably not more than 3%. In addition, very small orifices 40, 40 are provided near the outlets 24A and 26A of the first tubing 24 and the second tubing 26 into the merging zone 30, respectively (see FIG. 2). The pressure generated by the non-pulsating high pressure pump 36 and the small diameter of the orifice 40 are designed so that the solutions from the first and second tubings 24 and 26 may be discharged into the merging zone 30 in a high-speed jet at flow velocity not less than 100 m/min. The third tubing 28 is connected to the third storage tank 42 for storing aqueous hydrophilic dispersant solution, and a constant-pressure non-pulsating metering pump 44 for continuously metering aqueous hydrophilic dispersant solution is provided for the third tubing 28. By this setting, while merging aqueous silver salt solution flowing in the first tubing 24 and aqueous halide salt solution flowing in the second tubing 26 into the merging zone by high-velocity jets, aqueous hydrophilic dispersant solution is metered in continuously. Further, the outlet 28A of the third tubing 28 into the merging zone 30 preferably has a diameter so that the Reynolds number of the solution may be not less than 2,300, indicating a state of random flow. Introduction of this aqueous hydrophilic dispersant solution into the merging zone 30 is also possible through the second tubing 26 by dissolving the dispersant in aqueous halide salt solution, if the type of dispersant is appropriate, such as low molecular weight gelatin or PVA (polyvinyl alcohol).

The exhaust tubing 32 preferably has a diameter so that the mixed solution containing silver halide particles, produced by mixing reaction at the merging zone 30, may be discharged in a state of random flow having not less than 2,300 of Reynolds number. In addition, the cross section of the exhaust tubing 32 preferably becomes larger little by little as it becomes more distant from the merging zone 30. This prevents occurrence of back mixing, thereby preventing reentry of the produced particles into the reaction zone and the resulting growth.

Further, the merging zone 30 preferably has a volume so that the mixed solution to be discharged from the merging zone 30 into the exhaust tubing 32 may have residence time in the merging zone 30 not more than 0.01 seconds. Thus, the mixed solution mixed in the merging zone 30 is discharged through the exhaust tubing 32 at once without residing in the merging zone 30.

The mixing reaction tube 22 is provided with the cooler 46 for cooling the solution flowing in the mixing reaction tube 22. As a cooler, a cooling jacket 46 can be coated throughout the mixing reaction tube 22, for example, as illustrated in FIG. 2. The mixing reaction tube 22 may be fabricated so as to take a double tube structure comprising an inner tube and an outer tube, though not illustrated, and then it is also effective to flow the solution in the inner tube and flow cooling water between the inner and outer tubes countercurrently to the solution.

In the following, the manufacturing method according to the present invention will be described using the manufacturing apparatus 20 for silver halide emulsions which is configured described above.

A jet of aqueous silver salt solution flowing in the first tubing 24 and a jet of aqueous halide salt solution in the second tubing 26 are forced to merge in the merging zone 30, while aqueous hydrophilic dispersant solution is metered continuously from the third tubing 28 between the two jets that have already merged. Merge of the two jets described above in the merging zone 30 causes a state of random flow at high velocities and having not less than 2,300 of Reynolds number in the merging zone 30 due to great kinetic energy of the fluid, and thereby homogeneous, microscopic and instantaneous mixing of the three solutions, aqueous silver salt solution, aqueous halide salt solution and aqueous hydrophilic dispersant solution is attained. Mixing reaction occurring at this instant forms silver halide particles. In this case, the flow velocity where a jet of aqueous silver salt solution and a jet of aqueous halide salt solution are discharged in the merging zone 30 is preferably 100 m/sec or more, more preferably 200 m/sec or more, and most preferably 400 m/sec or more. Though the upper limit of flow velocity of jets may not exist, flow velocity not more than 700 m/sec may be preferable, considering increasing cost related to improvement in pumping capacity of a non-pulsating high pressure pump 36, pressure tightness of the mixing reaction tube 22 and so on.

In this way, aqueous silver salt solution and aqueous halide salt solution are discharged in the form of jet through the respective tubings 24 and 26 into the merging zone 30, and therefore silver halide particles produced by reaction do not deposit as agglomerating clods at the outlets 24A and 26A of the tubings 24 and 26 where aqueous silver salt solution and aqueous halide salt solution meet. Furthermore, when two jets of aqueous silver salt solution and aqueous halide salt solution merge, aqueous hydrophilic dispersant solution is continuously supplied between the two jets, resulting in preventing effectively silver halide particles from agglomerating. Thus, homogeneous mixing required to form preferable particles for silver halide emulsions, for example, highly monodisperse particles and highly planar particles, in case of planar particles, is attained.

Then, the mixed solution containing silver halide particles produced by mixing reaction in the merging zone 30 is discharged through the exhaust tubing 32 at once without residing in the merging zone 30. In this situation, it is preferable that residence time in the merging zone 30 is not more than 0.01 seconds and the Reynolds number of the mixed solution discharged through the exhaust tubing 32 is kept not less than 2,300. Thus, the problem that recirculation may take place in the phase of nuclear formation of silver halide particles can be avoided, and therefore nuclear formation can be promoted and size distribution of the nuclei is not broadened. Furthermore, silver halide particles produced do not deposit gradually as agglomerating clod on the inner wall of the merging zone 30 or on the inner wall of the exhaust tubing 32.

A jet flow in the mixing reaction tubing 22, especially in the first tubing 24 and in the second tubing 26 induces an increase in temperature of the solution in the mixing reaction tubing 22 and then increases the solubility of the system, and as the temperature increases, silver halide particles produced become larger in size. In the invention, the mixing reaction tubing 22 is provided with the cooler 46 to prevent an increase in temperature of the solution. A preferred range of temperature of the solution is from 5° C. to 75° C.

According to the present mixing method, the phenomenon of recirculation in the phase of nuclear formation of silver halide particles or generation of agglomerating clods is difficult to occur even if the silver salt concentration of aqueous silver salt solution and/or the halide salt concentration of aqueous halide salt solution are elevated. Accordingly, as it will be shown below, microparticles for silver halide emulsions which are microscopic, monodisperse and of a low rate of twin formation can be produced even in a high concentration range of aqueous silver salt solution and aqueous halide salt solution. Such improvments can increase productivity remarkably compared to conventional methods of manufacturing silver halide emulsions and apparatus thereof.

Aqueous silver salt solution used in the invention is typically aqueous silver nitrate solution. The concentration of aqueous silver salt solution may be 0.3 mol/l or more, while the upper limit is preferably not more than 4 mol/l, more preferably not more than 3 mol/l, and most preferably not more than 2 mol/l. The temperature of the solution is preferably from 5° C. to 75° C.

Aqueous halide salt solution used in the invention is typically aqueous solution of potassium bromide, sodium bromide, potassium chloride, sodium chloride, potassium iodide, sodium iodide and mixtures thereof. The concentration of aqueous halide salt solution may be 0.3 mol/l or more, while the upper limit is preferably not more than 4 mol/l, more preferably not more than 3 mol/l, and most preferably not more than 2 mol/l. The temperature of the solution is preferably from 5° C. to 75° C.

At least one of aqueous silver salt solution and aqueous halide salt solution preferably contains gelatin as protective colloid. Since gelatin greatly affects the rate of twin generation in silver halide microparticles produced, a preferred concentration of aqueous gelatin solution depends on the type of application of silver halide microparticles produced.

In the case where silver halide microparticles are utilized as nuclei in preparing planar silver halide particles, nuclei of parallel double twin are required, and then it is necessary to adjust both concentration of aqueous gelatin solution and molecular weight of gelatin so as to attain a desired rate of twin generation.

In case of application of silver halide microparticles to a nuclear growth process, it is preferable to dissolve added microparticles rapidly, thus fewer twins are preferable, and therefore a higher concentration of aqueous gelatin solution is preferable. The concentration of aqueous gelatin solution is preferably a concentration corresponding to addition of 0.1 g or more of gelatin per addition of 1 g of silver nitrate, more preferably addition of 0.2 g or more of gelatin and most preferably addition of 0.3 g or more of gelatin.

An increased concentration of aqueous gelatin solution increases the viscosity of the aqueous gelatin solution when the aqueous solution is cooled to a low temperature, thereby making it difficult to add he solution. Consequently, it is advisable to degrade gelatin to a lower molecular weight by means of oxygen degradation or dispersion with a high pressure flow homogenizer. The molecular weight of gelatin is preferably 100,000 or less, more preferably 50,000 or less, and most preferably 20,000 or less.

EXAMPLES

Comparative Example 1

Figure 4:
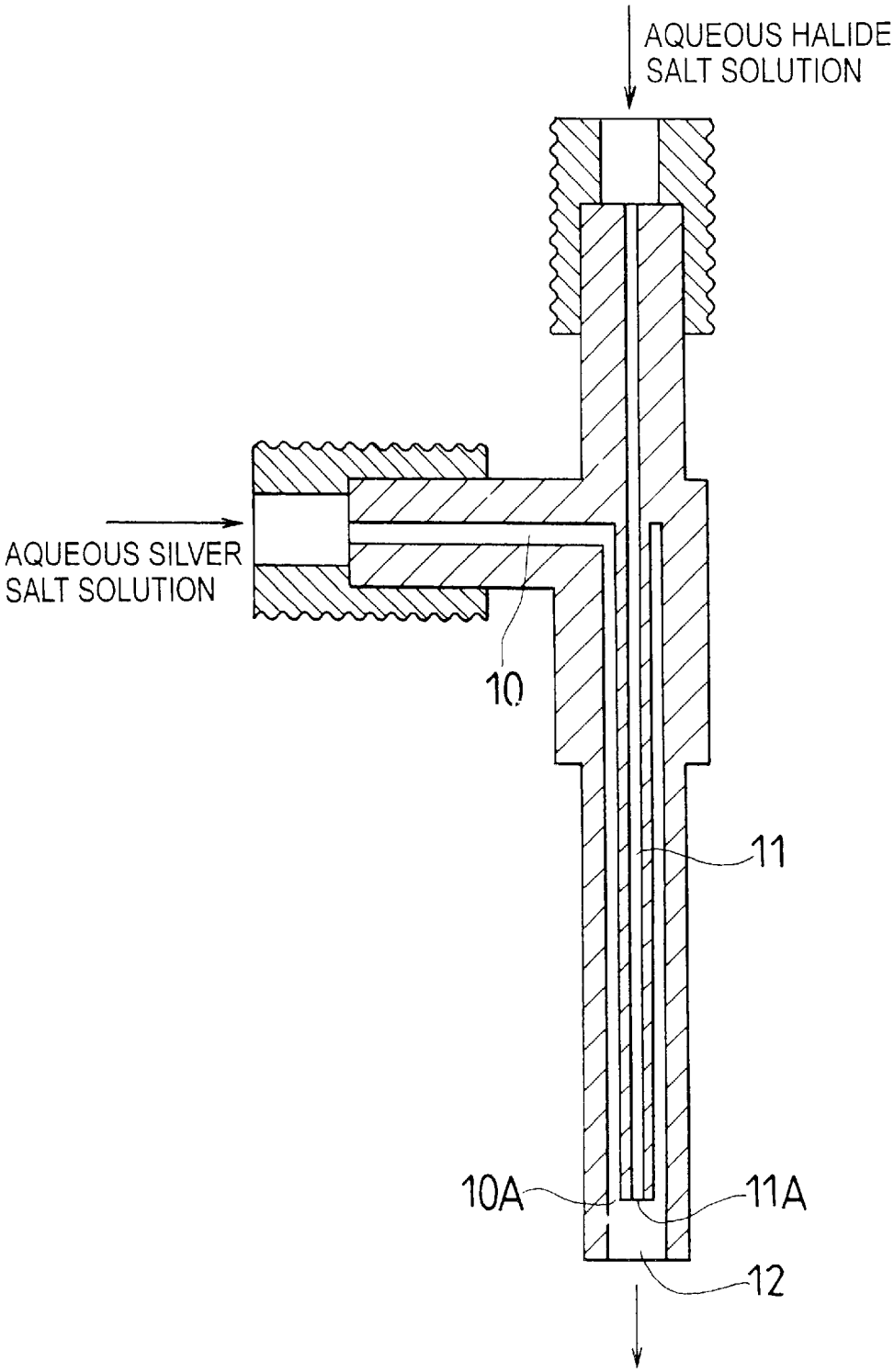
FIG. 4 PRIOR ART
FIG. 4 shows a longitudinal section of a conventional apparatus provided with in-line static mixing tubing for manufacturing silver halide emulsions.
Figure 5:
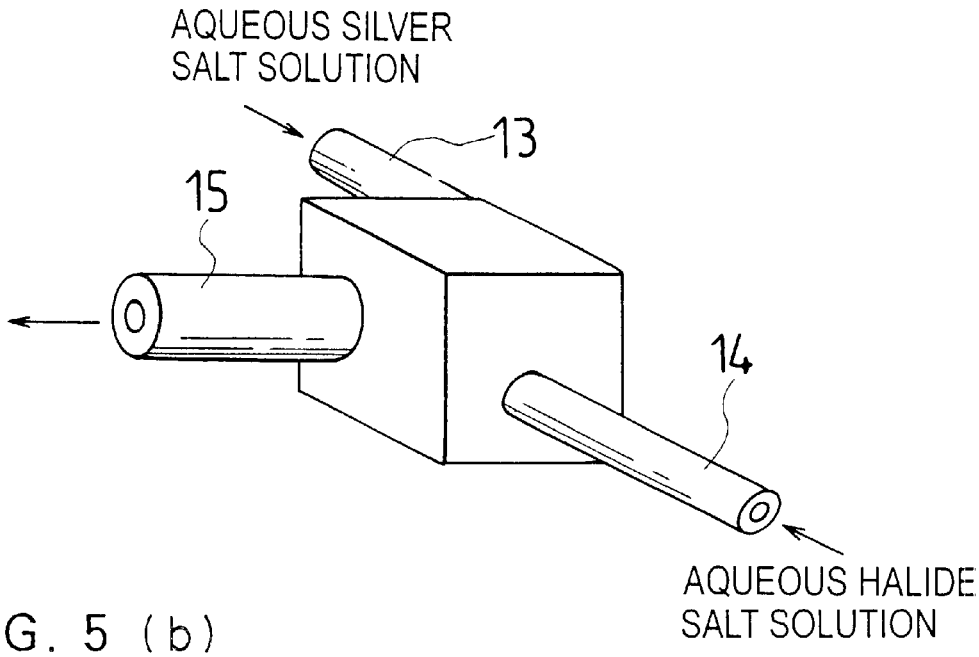
FIGS. 5(*a*) and 5(*b*) show a perspective view and a cross-sectional view of another conventional apparatus provided with in-line static mixing tubing for manufacturing silver halide emulsions.
Figure 5:
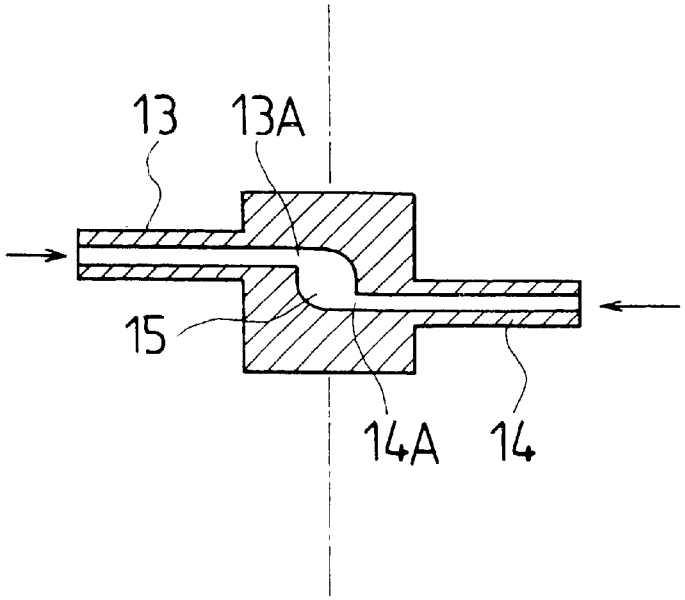

Comparative example 1 was conducted using a conventional in-line static mixing tubing type, as shown in FIGS. 4, 5(*a*) and 5(*b*), as apparatus for manufacturing silver halide emulsions. Aqueous silver nitrate solution at the concentration of 0.6826 mol/l and aqueous potassium bromide solution at the concentration of 0.6836 mol/l which contains 0.35% of concentration of low molecular weight gelatin (about 20,000 of molecular weight) were added at the flow rate of 490 cc/min, respectively, to produce silver bromide particles. The given concentrations of aqueous silver salt solution and aqueous halide salt solution were approximately twice as much as the conventional upper limit of concentration, that is, 0.3 mol/l. In addition, the solution containing silver bromide particles before they were discharged was kept at 7° C., while the solution containing silver bromide particles after they were discharged was kept at 10° C.

Comparative Example 2

Figure 3:
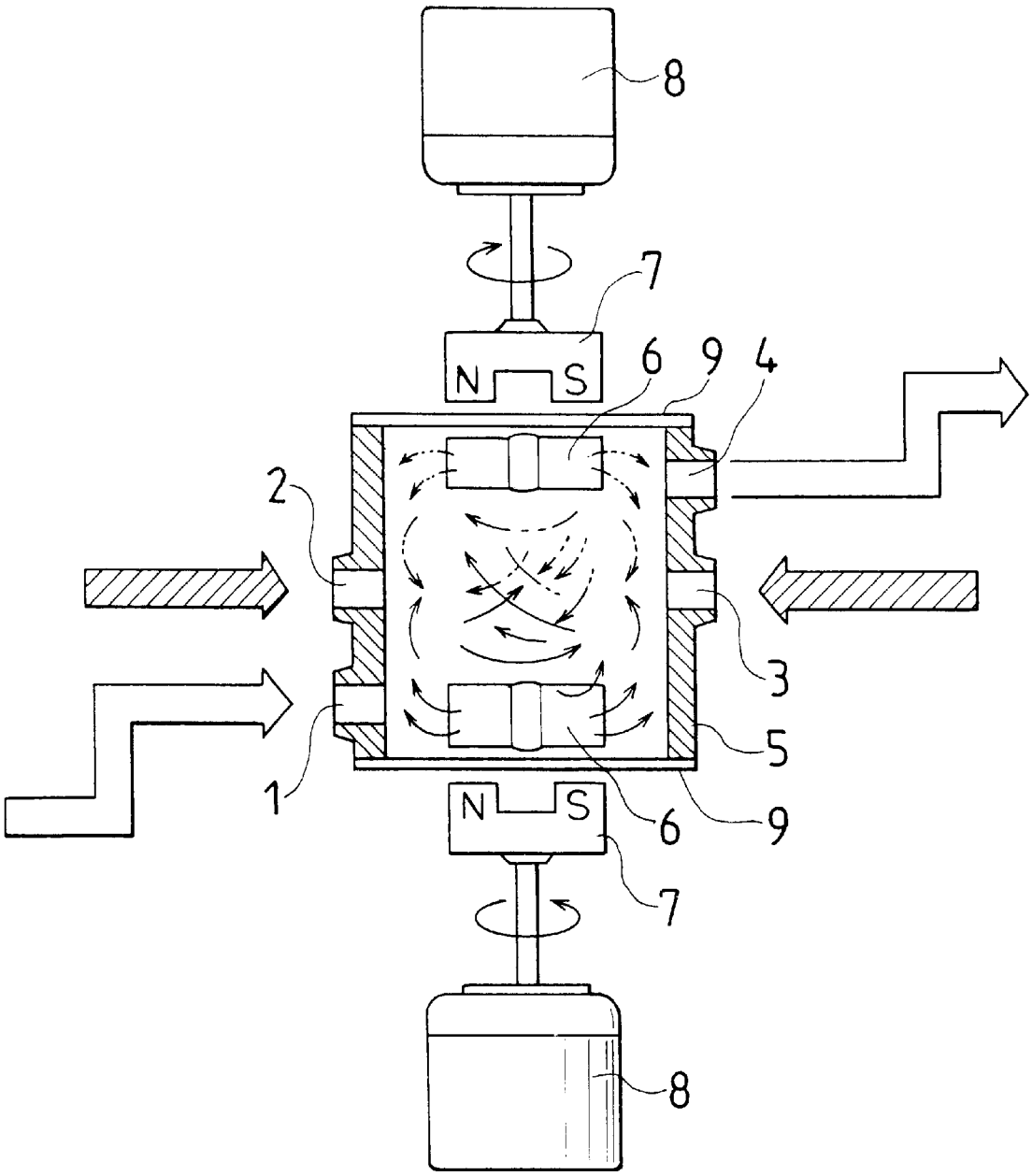
FIG. 3 PRIOR ART
FIG. 3 shows a longitudinal section of a conventional apparatus provided with stirring blades for manufacturing silver halide emulsions.

Comparative example 2 was conducted using a conventional stirring blade type, as shown in FIG. 3, as apparatus for manufacturing silver halide emulsions. Aqueous silver nitrate solution at the concentration of 0.6826 mol/l and aqueous potassium bromide solution at the concentration of 0.6836 mol/l which contains 0.350% of concentration of low molecular weight gelatin (about 20,000 of molecular weight) were added into the container at the flow rate of 490 cc/min, respectively, to produce silver bromide particles. In comparative example 2, the given concentrations of aqueous silver salt solution and aqueous halide salt solution were also approximately twice as much as the conventional upper limit of concentration, that is, 0.3 mol/l.

Example 1

Example 1 was conducted using the apparatus according to the present invention, as shown in FIG. 1 and FIG. 2, for manufacturing silver halide emulsions.

Aqueous silver nitrate solution at the concentration of 1.2826 mol/l was discharged as high velocity jet through the first tubing into the merging zone, and at the same time aqueous potassium bromide solution at the concentration of 1.2836 mol/l was discharged as high velocity jet through the second tubing into the merging zone. High velocity jets discharged through the first and the second tubings were generated by passing the jets through the orifice pore 0.1 mm in diameter under 210 MPa of discharging pressure. In case of this discharging pressure and orifice diameter, the rates of discharge of aqueous silver nitrate solution and aqueous potassium bromide solution were 280 cc/min identically, and fluid velocity of the jet was 594.5 m/sec. Then, aqueous gelatin solution at the concentration of 0.7% was metered continuously through the third tubing at the flow rate of 140 cc/min. Low molecular weight gelatin with about 20,000 of molecular weight was used as gelatin. The mixed solution containing silver nitrate particles produced in the merging zone was discharged immediately through the exhaust tubing. In example 1, the given concentrations of aqueous silver salt solution and aqueous halide salt solution were approximately four times as much as the conventional upper limit of concentration, that is, 0.3 mol/l, and approximately twice as much as that in comparative example 1 or comparative example 2. Further, the whole mixing reaction tube was cooled with the cooler, and the solution containing silver bromide particles after they were discharged through the exhaust tubing was kept at 10° C.

Results

In comparative example 1, agglomerating clods of silver bromide occurred at the front end of the nozzle where aqueous silver nitrate solution was introduced, and thus steady production of silver bromide particles could not be continued. Silver bromide particles produced in comparative example 1 had the mean particle diameter of 183.6 nm.

Silver bromide particles produced in comparative example 2 had the mean particle diameter of 85.1 nm.

On the contrary, in example 1, no agglomerating clod of silver bromide occurred at the outlet of the first tubing, in the merging zone or on the wall of the exhaust tubing. Silver bromide particles produced in example 1 had the mean particle diameter of 12.8 nm, a remarkably smaller value compared to those in the comparative examples, though the given concentrations of aqueous silver salt solution and aqueous halide salt solution were increased up to approximately twice as much as those in the comparative examples.

As described above, by using the method of manufacturing silver halide emulsions and the apparatus thereof according to the present invention, very fine silver halide particles with a mean diameter not more than 20 nm could be produced steadily and reproducibly without occurrence of agglomerating clods, from aqueous silver salt solution and aqueous halide salt solution at the high level of concentration not less than 0.3 mol/l.

Mean particle diameters of silver bromide microparticles were measured with the same method to compare measured data between the example and comparative examples. The method of measurement will not be described in detail, but mean particle diameters were calculated from the intensities of light scattering at 600 nm of wave length, as described in J. Imag. Sci. Tech., 37, 272–280.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a silver halide emulsion, consisting essentially of:

forcing a jet of aqueous silver salt solution and a jet of aqueous halide salt solution to merge in a merging zone to induce mixing action by means of kinetic energy of fluid in the merging zone;

continuously supplying aqueous hydrophilic dispersant solution between the two jets to mix the three solutions instantaneously; and immediately removing the mixed solution containing silver halide particles which have been formed by reaction caused by the mixing out of the merging zone.

2. The method according to claim 1, wherein said two jets are discharged into said merging zone as high velocity jet with fluid velocity not less than 110 m/sec.

3. The method according to claim 1, wherein residence time of said mixed solution in said merging zone is not more than 0.01 seconds.

4. The method according to claim 1, wherein Reynolds number at an outlet in said merging zone is not less than 2,300.

5. A method of manufacturing a silver halide emulsion, wherein:

a jet of aqueous silver salt solution and a jet of aqueous halide salt solution are forced to merge in a merging zone to induce mixing action by means of kinetic energy of fluid in the merging zone;

aqueous hydrophilic dispersant solution is supplied continuously between the two jets to mix the three solutions instantaneously; and the mixed solution containing silver halide particles which have been formed by reaction caused by the mixing is immediately removed out of the merging zone, wherein a concentration of said aqueous silver salt solution is not less than 0.3 mol/l and not more than 4 mol/l.

6. The method according to claim 5, wherein said two jets are discharged into said merging zone as high velocity jet with fluid velocity not less than 100 m/sec.

7. The method according to claim 5, wherein residence time of said mixed solution in said merging zone is not more than 0.01 seconds.

8. The method according to claim 5, wherein Reynolds number at an outlet in said merging zone is not less than 2,300.

* * * * *